US010763035B2

(12) United States Patent
Horie et al.

(10) Patent No.: US 10,763,035 B2
(45) Date of Patent: Sep. 1, 2020

(54) COMMON MODE FILTER

(71) Applicant: TAIYO YUDEN CO., LTD., Tokyo (JP)

(72) Inventors: Katsuyuki Horie, Tokyo (JP); Sho Tamura, Tokyo (JP)

(73) Assignee: TAIYO YUDEN CO., LTD., Tokyo (JP)

( * ) Notice: Subject to any disclaimer, the term of this patent is extended or adjusted under 35 U.S.C. 154(b) by 197 days.

(21) Appl. No.: 15/850,352

(22) Filed: Dec. 21, 2017

(65) Prior Publication Data

US 2018/0182534 A1 Jun. 28, 2018

(30) Foreign Application Priority Data

Dec. 27, 2016 (JP) ..... 2016-252921

(51) Int. Cl.
*H01F 27/28* (2006.01)
*H01F 27/29* (2006.01)
*H01F 17/00* (2006.01)

(52) U.S. Cl.
CPC ..... *H01F 27/2828* (2013.01); *H01F 27/292* (2013.01); *H01F 2017/0093* (2013.01)

(58) Field of Classification Search
CPC ..... H01F 27/2823; H01F 27/292; H01F 27/2828; H01F 2027/2838; H01F 17/045; H01F 27/29; H01F 41/06; H01F 41/064; H01F 41/069
USPC ..... 336/83, 192
See application file for complete search history.

(56) References Cited

U.S. PATENT DOCUMENTS

2001/0038327 A1 11/2001 Aoki et al.
2008/0003864 A1* 1/2008 Hatakeyama ..... H01F 17/045 439/399
2009/0045902 A1 2/2009 Hirai
2015/0371766 A1* 12/2015 Kawasaki ..... H01F 17/045 336/192
2017/0301455 A1* 10/2017 Kobayashi ..... H01F 27/24
2017/0345557 A1* 11/2017 Igarashi ..... H01F 27/292

FOREIGN PATENT DOCUMENTS

JP 2002-008931 A 1/2002
JP 2005-056934 A 3/2005
JP 2010165953 A * 7/2010
JP 2012-029210 A 2/2012
WO 2008/096487 A1 8/2008

* cited by examiner

*Primary Examiner* — Tszfung J Chan
(74) *Attorney, Agent, or Firm* — Pillsbury Winthrop Shaw Pittman, LLP

(57) ABSTRACT

A common mode filter includes a drum core that includes a first flange, a second flange and a winding core; a first winding wire wound around the winding core from a first winding start position to a first winding end position; and a second winding wire wound around the winding core from a second winding start position to a second winding end position. The first winding start position and the second winding start position are arranged at an equal distance from the first flange and arranged symmetrically to each other with respect to a center of the winding core. The first winding end position and the second winding end position are arranged at an equal distance from the second flange and arranged symmetrically to each other with respect to the center of the winding core.

6 Claims, 20 Drawing Sheets

COMMON MODE FILTER

CROSS-REFERENCE TO RELATED APPLICATIONS

This application is based on and claims the benefit of priority from Japanese Patent Application Serial No. 2016-252921 (filed on Dec. 27, 2016), the contents of which are hereby incorporated by reference in its entirety.

TECHNICAL FIELD

The present discloser relates to a common mode filter, and more particularly to a winding-type common mode filter.

BACKGROUND

Common mode filters have been known as one of electronic components used for high-frequency circuits. There are mainly two types of common mode filters, one is a winding type and the other is a thin film type. For high frequency circuits, winding-type common mode filters are often used.

A winding-type common mode filter includes a drum core, two winding wires wound around the drum core, and a plurality of terminal electrodes that are each electrically connected to ends of the two windings. The drum core has a pair of flanges and a winding core that connects the pair of flanges. Each of the two windings has a winding portion wound around an outer peripheral surface of the winding core and a lead portion that extends from each end of the winding portion to a tip of the winding.

Each of the two windings is electrically connected with a corresponding terminal electrode at its lead portion. The winding portion is wound around the winding core such that it contacts the outer peripheral surface of the winding core. The winding portion has more than one turn. In order to match a characteristic impedance of the winding, it is desirable that a capacitances generated between two adjacent turns in the winding portion be constant by arranging the turns at a regular interval in the winding portion.

Conventional winding-type common mode filters are disclosed in, for example, Japanese Patent Application Publication No. 2005-56934 ("the '934 Publication"), Japanese Patent Application Publication No. 2012-29210 ("the '210 Publication"), Japanese Patent Application Publication No. 2002-008931 ("the '931 Publication"), and International Publication WO 2008/096487 ("the '487 Publication"). In these conventional common mode filters, terminal electrodes are provided on a lower surface or an upper surface of the flange, and the lead portion of the winding is coupled to a junction portion of a terminal electrode.

It is desirable that the two windings of the common mode filter are formed to have the same length. This is because it is difficult to match the characteristic impedance if the two windings have different lengths.

However, in conventional common mode filters in which the terminal electrodes are provided on one of the lower surface or the upper surface of the flange, the geometrical arrangement of the two windings, in particular, the geometrical arrangement of the lead portions becomes asymmetric with respect to each other, and therefore it is difficult to make the lengths of the two windings equal to each other.

When a general-purpose drum core is used, it is particularly difficult to make the length of the lead portion of one of the two windings equal to the length of the lead portion of the other winding. For example, when a general-purpose drum core is used, to obtain a small inductance design, the number of turns of the winding around the winding core is decreased. Accordingly, referring to FIG. 3 of the '487 Publication, the windings are disproportionally arranged toward one of the flanges.

As described in the '210 Publication, when two windings are bifilar-wound, if a distance between adjacent turns of the two windings is made constant, the two windings can be each formed symmetrically with respect to the center of the winding core of the drum core in the length direction of the winding core. However, as pointed out in paragraph [0006] of the '210 Publication, it is difficult to bifilar-wind the two wires such that the interval between the two windings becomes constant.

FIG. 5 of the '931 Publication discloses a common mode filter in which a concave portion is formed on each end surface of each flange and a terminal electrode is provided in each of the concave portions. In such a configuration, it is possible to arrange the two windings geometrically symmetrical by providing the terminal electrodes on the two opposing side surfaces of each flange.

However, in the common mode filter described in the '931 Publication, the lead portion of each winding is connected to the terminal electrode in a slack state. More specifically, the lead portion of each winding extends in a slight arc from the boundary with the winding portion to the junction portion (the conductive connecting portion E) with the terminal electrode. Therefore, the length of the lead portion changes depending on the looseness of the lead portion. Moreover, when the lead portion is slack, it may lead to variation in the intervals between adjacent turns of the winding portion. In the common mode filter described in the '931 Publication, since the end portions of the windings are bonded to the flat electrode layer by welding or the like, it is difficult to keep the windings tensioned when the windings are bonded to the electrode layer. When the windings are not tensioned at the time of bonding, the windings are jointed to the terminal electrodes such that they remain in a slack state. As described above, in the common mode filter of the '931 Publication, it is difficult to bond the lead and end portions of the winding to the terminal electrodes without any slack.

SUMMARY

One object of the disclosure is to provide a winding-type common mode filter in which the lengths of the two windings are made equal. More specifically, provided is a common filter in which the lengths of the two windings are made equal even when the windings are disproportionally arranged on one side. Other objects of the present invention will be made apparent through description of the specification as a whole.

A common mode filter according to one embodiment of the disclosure is a winding-type common mode filter that includes a drum core, and a pair of winding wires wound around the drum core. The drum core includes a winding core, a first flange provided on one end of the winding core, and a second flange provided on the other end of the winding core. The first flange has a first lower surface that faces a mounting surface of a circuit board and a pair of first end surfaces that intersect the first lower surface, and the second flange has a second lower surface that faces the mounting surface of the circuit board and a pair of second end surfaces that intersect the second lower surface.

The common mode filter according to the embodiment further includes a first terminal electrode, a second terminal electrode, a third terminal electrode, and a fourth terminal electrode. The first terminal electrode and the third terminal electrode are provided on the first flange, and the second terminal electrode and the fourth terminal electrode are provided on the second flange.

In one embodiment, the first terminal electrode includes a first securing portion for securing a first lead portion of a first winding wire, the second terminal electrode includes a second securing portion for securing a second lead portion of the first winding wire, the third terminal electrode includes a third securing portion for securing a third lead portion of a second winding wire, and the fourth terminal electrode includes a fourth securing portion for securing a fourth lead portion of the second winding wire.

In one embodiment, the first terminal electrode includes a first junction surface disposed on one of the pair of the first end surfaces, and a first clamping piece formed on the first junction surface. The second terminal electrode includes a second junction surface disposed on one of the pair of the second end surfaces, and a second clamping piece formed on the second junction surface. The third terminal electrode includes a third junction surface disposed on the other of the pair of the first end surfaces, and a third clamping piece formed on the third junction surface. The fourth terminal electrode includes a fourth junction surface disposed on the other of the pair of the second end surfaces, and a fourth clamping piece formed on the fourth junction surface.

In one embodiment, the pair of winding wires includes a first winding wire and a second winding wire. The first winding wire includes a first winding portion, a first lead portion, and a second lead portion. The first winding portion is wound around the winding core from a first winding start position to a first winding end position on the winding core. The first lead portion extends from the first winding start position and is secured by the first securing portion to be connected to the first terminal electrode. The second lead portion extends from the first winding end position and is secured by the second securing portion to be connected to the second terminal electrode. The second winding wire includes a second winding portion, a third lead portion, and a fourth lead portion. The second winding portion is wound around the winding core from a second winding start position to a second winding end position on the winding core. The third lead portion extends from the second winding start position and is secured by the third securing portion to be connected to the third terminal electrode. The fourth lead portion extends from the second winding end position and is secured by the fourth securing portion to be connected to the fourth terminal electrode. The second winding portion is wound by the same number of turns and in the same direction as the first winding wire.

In the above-described embodiment, the length of the winding portion (the first winding portion) of the first winding wire and the length of the winding portion (the second winding portion) of the second winding wire are equal to each other.

In one embodiment, the first securing portion includes a first junction surface and a first clamping piece. The second securing portion includes a second junction surface and a second clamping piece. The third securing portion includes a third junction surface and a third clamping piece. The fourth securing portion includes a fourth junction surface and a fourth clamping piece. In this embodiment, the first lead portion is clamped between the first junction surface and the first clamping piece to be connected to the first terminal electrode. The second lead portion is clamped between the second junction surface and the second clamping piece to be connected to the second terminal electrode. The third lead portion is clamped between the third junction surface and the third clamping piece to be connected to the third terminal electrode. The fourth lead portion is clamped between the fourth junction surface and the fourth clamping piece to be connected to the fourth terminal electrode.

In one embodiment, the first winding start position and the second winding start position are arranged at an equal distance from the first flange and arranged symmetrically to each other with respect to a center of the winding core. The first winding end position and the second winding end position are arranged at an equal distance from the second flange and arranged symmetrically to each other with respect to the center of the winding core.

In one embodiment, the first securing portion and the third securing portion are arranged symmetrically to each other with respect to the center of the winding core, and the second securing portion and the fourth securing portion are arranged symmetrically to each other with respect to the center of the winding core.

According to the above embodiment, the length of the first lead portion of the first winding wire and the length of the third lead portion of the second winding wire are equalized to each other due to the geometric symmetry between the first winding start position and the second winding start position, and the geometric symmetry between the first clamping piece and the third clamping piece. Similarly, the length of the second lead portion of the first winding wire and the length of the fourth lead portion of the second winding wire are equalized to each other due to the geometric symmetry between the first winding end position and the second winding end position, and the geometric symmetry between the second clamping piece and the fourth clamping piece.

In one embodiment, the first lead portion extends linearly from the first winding start position to an inner end of the first end surface on which the first securing portion is disposed. The second lead portion extends linearly from the first winding end position to an inner end of the second end surface on which the second securing portion is disposed. The third lead portion extends linearly from the second winding start position to an inner end of the first end surface on which the third securing portion is disposed. The fourth lead portion extends linearly from the second winding end position to an inner end of the second end surface on which the fourth securing portion is disposed.

According to the above embodiment, since the geometric symmetry between the first lead portion and the corresponding third lead portion, and the geometric symmetry between the second lead portion and the corresponding fourth lead portion are given, and each lead portion is linearly formed so that slack of each lead portion will not occur. Consequently it is possible to make the length of the first lead portion equal to the length of the third lead portion, and it is possible to make the length of the second lead portion equal to the length of the fourth lead portion. Moreover, the length of the first winding portion and the length of the second winding portion is equalized as described above. Therefore it is possible to make the length of the first winding wire equal to the length of the second winding wire. Furthermore, since each lead portion of the winding wires is clamped between the corresponding clamping piece and the corresponding junction surface, it is possible to prevent the slack of the winding wires.

In one embodiment, the first lead portion is arranged along a first line that connects the first winding start position and a first clamping point situated at a position closest to the first winding start position in the first clamping piece as viewed from the front. The second lead portion is arranged along a second line that connects the first winding end position and a second clamping point situated at a position closest to the first winding end position in the second clamping piece as viewed from the front. The third lead portion is arranged along a third line that connects the second winding start position and a third clamping point situated at a position closest to the second winding start position in the second clamping piece as viewed from the front. The fourth lead portion is arranged along a fourth line that connects the second winding end position and a fourth clamping point situated at a position closest to the second winding end position in the second clamping piece as viewed from the front.

This arrangement can be realized by applying tension to the lead portions to such an extent that the looseness does not occur when the lead portions are clamped between the corresponding clamping pieces and the corresponding junction surfaces. According to this embodiment, it is possible to prevent a difference in the lengths of the winding wires caused by the slack of the lead portions.

In one embodiment, the first clamping piece is folded toward the first junction surface along a first folding line. The first folding line is inclined with respect to the first line as viewed from the front. The first junction portion is bent at the first clamping point toward the first folding line.

According to this embodiment, since the first junction portion of the first winding wire is bent at the first clamping point toward the first folding line, even when a force is applied to the first winding wire in a direction in which the first winding wire comes off from the first clamping piece, the bent portion is caught by the clamping piece, which prevents the first junction portion of the first winding wire from coming off from the first clamping piece.

In one embodiment, the first clamping piece is folded toward the first junction surface along a first folding line that is arranged collinearly with the first line as viewed from the front.

According to this embodiment, since the direction in which the first lead portion of the first winding wire extends (the direction along the first line) is arranged collinearly with the folding line of the first clamping piece, the first lead portion can be clamped over the entire length of the clamping piece along the folding line, so that it is possible to hold the first lead portion stably.

According to each embodiment of the disclosure, it is possible to obtain a common mode filter in which the first winding wire and the second winding wire have the same length. Therefore, characteristic impedances of the two windings can be easily matched to a predetermined value (for example, 50Ω or 100Ω). Moreover, since the terminal electrodes are provided on the side surfaces of the flange, it is possible to obtain a thin common mode filter compared to ones that have the terminal electrodes on its upper and lower surfaces.

BRIEF DESCRIPTION OF THE DRAWINGS

FIG. 9*a* illustrates one of the terminal metal attachments in FIG. 8 before bent, FIG. 9*b* is a front view showing the bent terminal metal attachment, FIG. 9*c* is a side view of the terminal metal attachment of FIG. 9*b* viewed from the direction of the arrow F4.

FIG. 11*a* illustrates the terminal metal attachment in which the winding is temporarily fixed to a clamping piece. FIG. 11*b* illustrates the terminal metal attachment in which the clamping piece is folded. FIG. 11*c* illustrates the terminal metal attachment in which the winding is welded.

DESCRIPTION OF THE EMBODIMENTS

Figure 1:
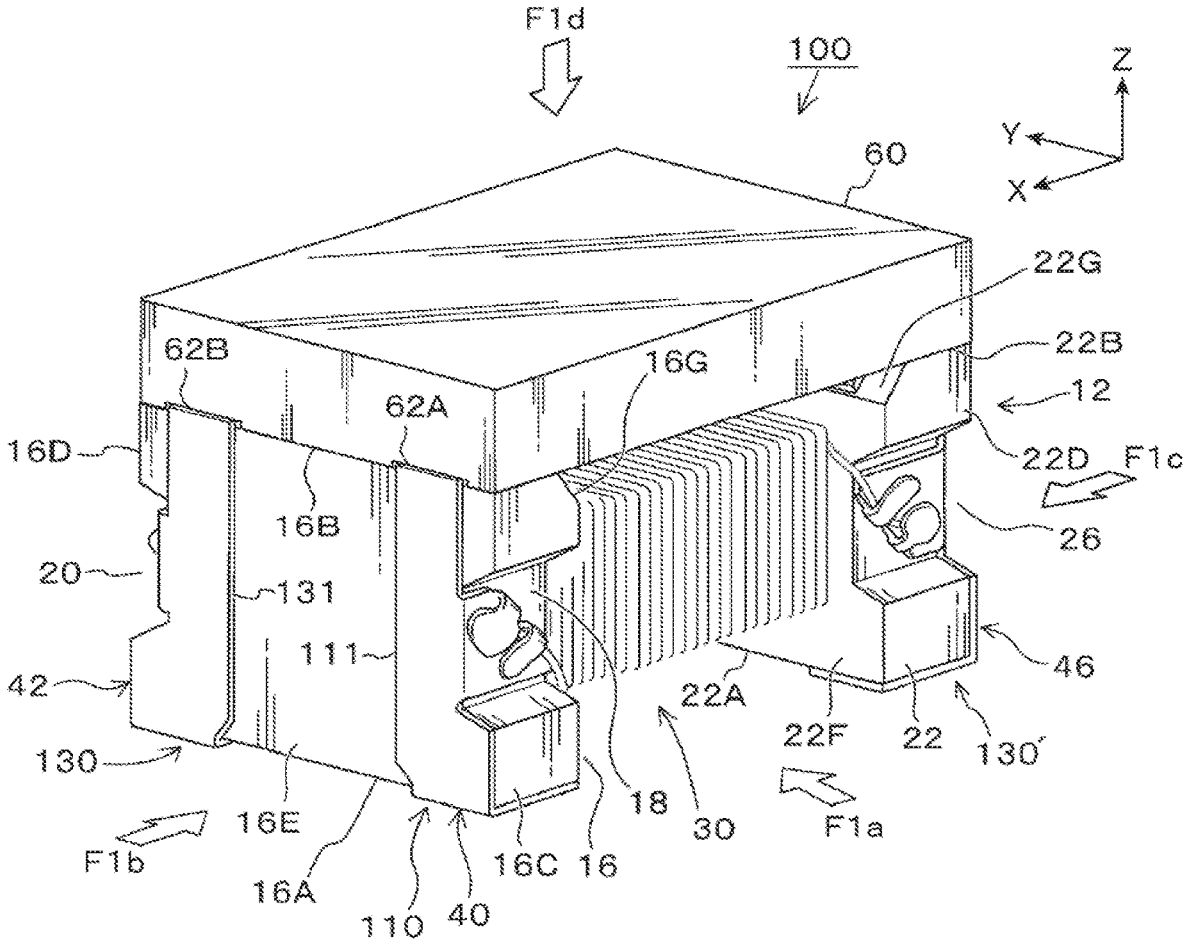
FIG. 1 is a perspective view of a common mode filter according to one embodiment of the disclosure.

Various embodiments of the invention will be described hereinafter with reference to the drawings. In the drawings, like elements are designated by like reference numerals throughout. It should be noted that the drawings do not necessarily appear in accurate scales, for convenience of description.

Figure 2:
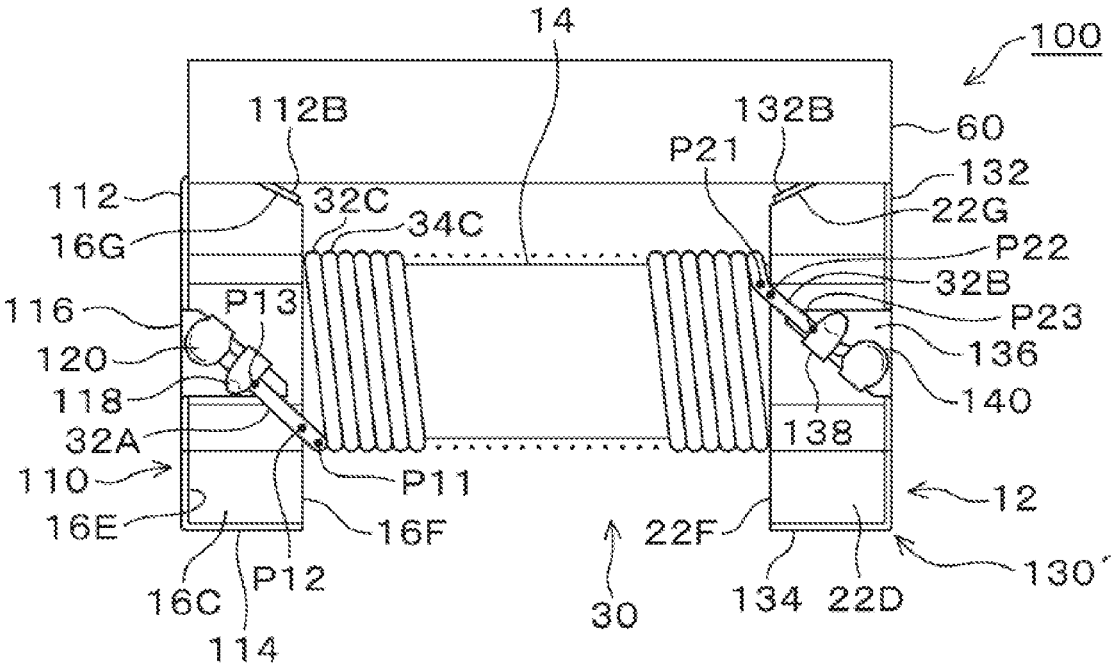
FIG. 2 is a front view of the common mode filter of FIG. 1 viewed from the front (viewed from the arrow F1*a*).
Figure 3:
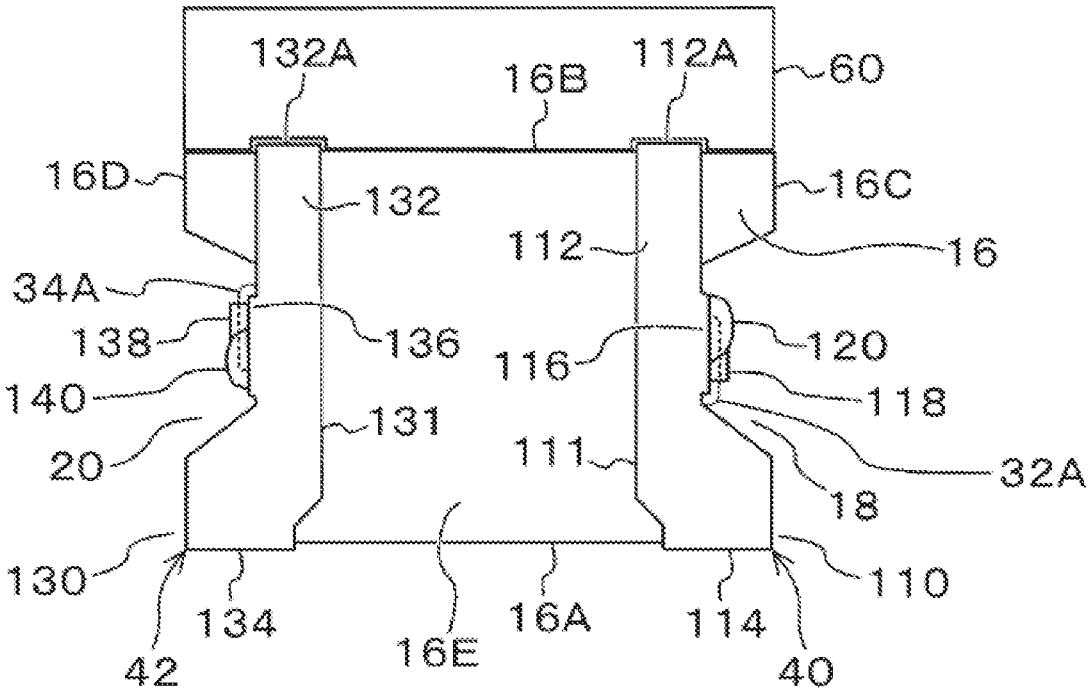
FIG. 3 is a side view of the common mode filter of FIG. 1 as viewed from the left side surface (as viewed from the arrow F1*b*).
Figure 4:
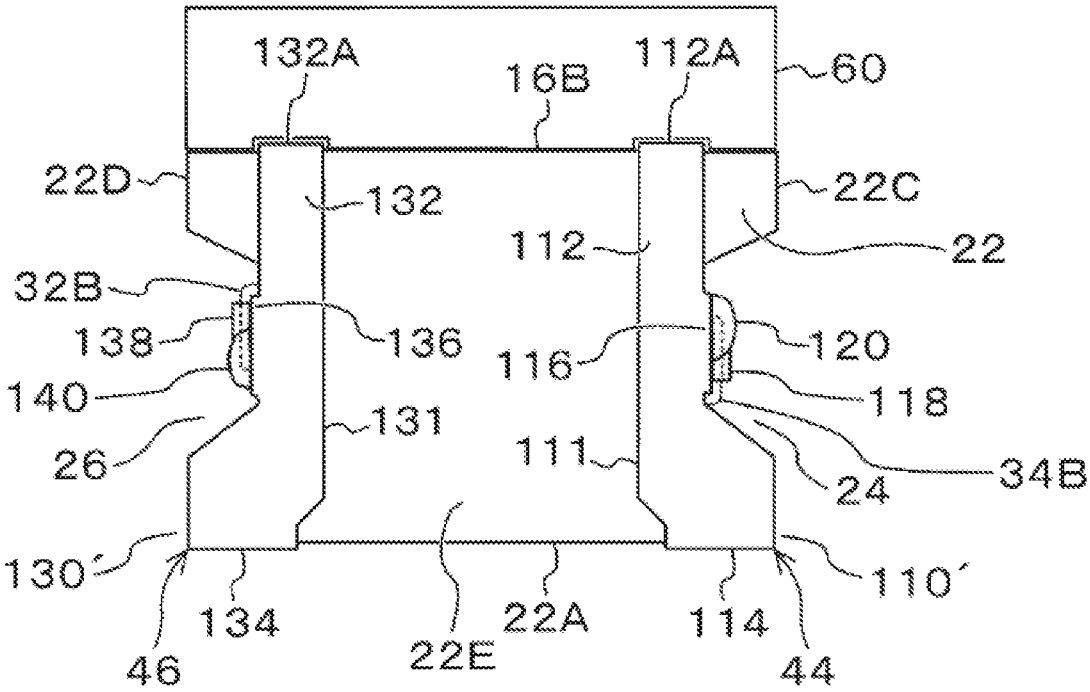
FIG. 4 is a side view of the common mode filter of FIG. 1 as viewed from the right side surface (as viewed from the arrow F1*c*).

A common mode filter 100 according to an embodiment of the disclosure will be now described with reference to FIGS. 1 to 4. FIG. 1 is a perspective view of a common mode filter 100 according to the embodiment of the disclosure, FIG. 2 is a front view of the common mode filter 100 viewed from the front (viewed from the arrow F1*a*), and FIG. 3 is a side view of the common mode filter 100 viewed from a left side surface (viewed from the arrow F1*b*), and FIG. 4 is a side view of the common mode filter 100 viewed from a right side surface side (viewed from the arrow F1*c*).

In the illustrated embodiment, the common mode filter 100 includes a drum core 12, a winding part 30, terminal electrodes 40, 42, 44, 46, and a plate core 60.

In one embodiment of the invention, the drum core 12 includes a winding core 14 that has a substantially rectangular cross section, a substantially rectangular parallelepiped flange 16 provided at one end of the winding core 14 in the axial direction, and a substantially rectangular parallelepiped flange 22 provided at the other end of the winding core 14 in the axial direction. The drum core 12 is formed of, for example, a Ni—Zn ferrite material. In one embodiment of the disclosure, the permeability (μ) of the drum core 12 is in the range of 400 to 1000, for example 500. In addition to the rectangular shape, the cross-sectional shape of the winding core 14 may be a polygon such as a hexagon or an octagon, or it may be a circle or an ellipse. The cross-sectional shape of the winding core 14 may take any shape as long as it does not contradict the gist of the invention.

In one embodiment of the disclosure, the common mode filter 100 is configured to have the dimension 4.5 mm (length)×3.2 mm (width)×2.8 mm (height). Here, the length of the common mode filter 100 is the dimension in an axial direction (the X direction in FIG. 1) of the winding core 14 of the drum core 12. The width of the drum core 12 is the dimension in a direction perpendicular to the X direction and parallel to a mounting surface (the Y direction in FIG. 1). The height of the drum core 12 is the dimension in a direction orthogonal to the X direction and the Y direction (the Z direction in FIG. 1). The winding core 14 of the drum core 12 is configured to have a width (the dimension in the Y direction in FIG. 1) of 1.6 mm and a height (the dimension in the Z direction in FIG. 1) of 0.8 mm. The drum core 12 is configured to have a length (the dimension in the X direction in FIG. 1) of 4.3 mm, a width (the dimension in the Y direction of FIG. 1) of 3.2 mm, and a height (the dimension in the Z direction in FIG. 1) of 2.1 mm.

In one embodiment, the winding part 30 includes two winding wires 32, 34. In the illustrated embodiment, the winding wire 32 is wound around the outer surface of the winding core 14. One end of the wire 32 is electrically connected to the terminal electrode 40 and the other end of the winding wire 32 is electrically connected to the terminal electrode 46. Like the winding wire 32, the winding wire 34 is wound around the outer surface of the winding core 14. One end of the wire 34 is electrically connected to the terminal electrode 42 and the other end of the wire 34 is electrically connected to the terminal electrode 44. In one embodiment of the disclosure, AIW (polyamideimide copper wire) φ 0.05 mm can be used as the windings 32, 34.

In one embodiment, the winding wire 32 and the winding wire 34 are wound on the outer surface of the winding core 14 in the same circumferential direction and by the same number of turns. In one embodiment, the winding wire 32 and the winding wire 34 are wound on the outer surface of the winding core 14 at the same pitch.

The flange 16 has a lower surface 16A, an upper surface 16B, an end surface 16C, an end surface 16D, a side surface 16E, and a side surface 16F. The flange 22 has a lower surface 22A, an upper surface 22B, an end surface 22C, an end surface 22D, a side surface 22E and a side surface 22F. The lower surface 16A and the lower surface 22A are surfaces that face a circuit board (not shown) when the common mode filter 100 is mounted on the circuit board. Each of the end surfaces 16C and 16D intersects with the lower surface 16A at the lower end thereof and each of the end surfaces 22C and 22D intersects with the lower surface 22A at its lower end. In the illustrated embodiment, chamfered portions 16G, 22G are formed from the upper surfaces 16B, 22B of the flanges 16, 22 toward the inner side surfaces 16F, 22F. The chamfered portions 16G, 22G are provided for securing terminal metal attachments 110, 110', 130, 130'.

Grooves 18, 20 are formed on the end surface 16C and the end surface 16D of the flange 16 respectively. The grooves 18, 20 are formed such that they extend across the center in the upper-lower direction of the end surfaces 16C, 16D. In the illustrated example, the grooves 18 and 20 are formed such that the end surfaces 16C, 16D are each connected to the corresponding bottom portion of the groove via tapered surfaces. Consequently, the bottom surfaces of the grooves 18, 20 are provided at positions receding inward from the end surfaces 16C, 16D. The tapered surfaces of the end surfaces 16C, 16D are provided on each side of the corresponding bottom surface in the end surfaces 16C, 16D. The angle of the tapered surfaces of the end surfaces 16C, 16D is adequately determined according to requirements that includes the directions (lead out direction) in which the winding wires 32, 34 extend. In this specification, the tapered surfaces and the bottom surfaces of the grooves 18, 20 are regarded as a part of the end surfaces 16C, 16D, respectively. Like the grooves 18 and 20 formed in the flange 16, grooves 24 and 26 are also formed in the flange 22.

In one embodiment, the flanges 16, 22 are configured to have a thickness of 0.6 mm. Each of the grooves 18, 20, 24, 26 is configured such that its bottom portion has a width of 0.7 mm and a depth of 0.5 mm.

The terminal electrodes 40, 42 are provided on one flange 16, and the terminal electrodes 44, 46 are provided on the other flange 22. In the illustrated embodiment, the terminal electrode 40 includes the terminal metal attachment 110, the terminal electrode 42 includes the terminal metal attachment 130, the terminal electrode 44 includes the terminal metal attachment 110', and the terminal electrode 46 includes the terminal metal attachment 130'. Each of the terminal metal attachments 110, 110', 130, 130' is made of, for example, a phosphor bronze plate or a copper plate.

The terminal metal attachment 110 is provided on the end surface 16C of the flange 16, and the terminal metal attachment 130 is provided on the end surface 16D. Further, the terminal metal attachment 110' is provided on the end surface 22C of the flange 22, and the terminal metal attachment 130' is provided on the end surface 22D.

Figure 8:
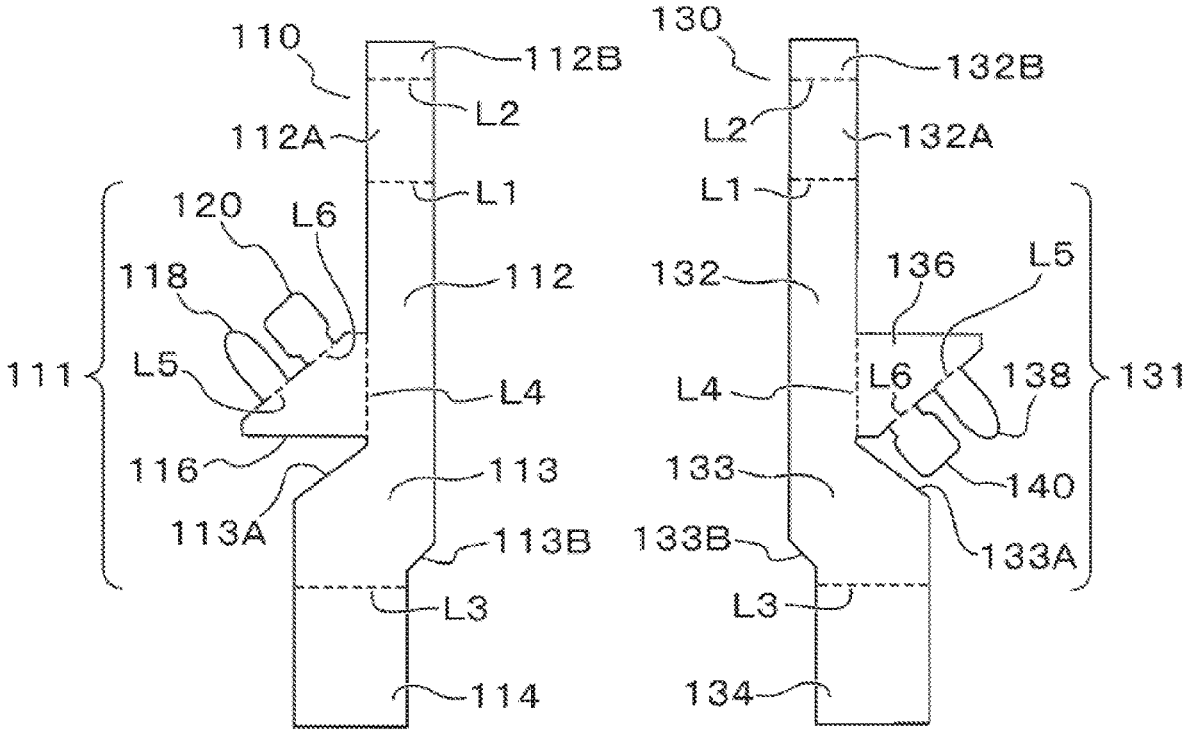
FIG. 8 is a developed view of terminal metal attachments of the common mode filter of FIG. 1.

The terminal metal attachment 110 will be now further described with reference to FIG. 8. FIG. 8 is a developed view of the terminal metal attachment 110 and the terminal metal attachment 130. Since the terminal metal attachment 110' is formed in the same shape as the terminal metal attachment 110 and the terminal metal attachment 130' is formed in the same shape as the terminal metal attachment 130, only the terminal metal attachment 110 and the terminal metal attachment 130 are shown in FIGS. 8 and 9. The description of the terminal metal attachment 110' and the terminal metal attachment 130' will be hereunder omitted.

Referring to FIGS. 8 and 9, the terminal metal attachment 110 has a side surface portion 111. The side surface portion 111 has a planar strip portion 112 and a wide expanded portion 113 formed so as to be continuous with the strip portion 112. The expanded portion 113 is connected to the strip portion 112 via the side portions 113A, 113B which are inclined with respect to the long side of the strip portion 112. In one embodiment of the disclosure, a junction surface 116 having a triangular shape is provided near the lower end of the strip portion 112. On the oblique side of the junction surface 116 that faces upward, there are provided a clamping piece 118 for clamping the windings 32, 34 between itself and the junction surface 116, and a fastening portion 120 where the winding wires 32, 34 are secured by welding.

The terminal metal attachment 130 has a side surface portion 131. The side surface portion 131 has a planar strip portion 132 and a wide expanded portion 133 formed so as to be continuous with the strip portion 132. The position of the expanded portion 133 is shifted from the strip portion 132 by being connected to the strip portion 132 via the inclined side portions 133A, 133B. A triangular junction surface 136 is provided on the lower side of the strip portion 132. On the oblique side of the junction surface 136 that faces upward, there are provided a clamping piece 138 for clamping the windings 32, 34 between itself and the junction surface 136, and a fastening portion 140 where the winding wires 32, 34 are secured by welding.

Figure 9A:
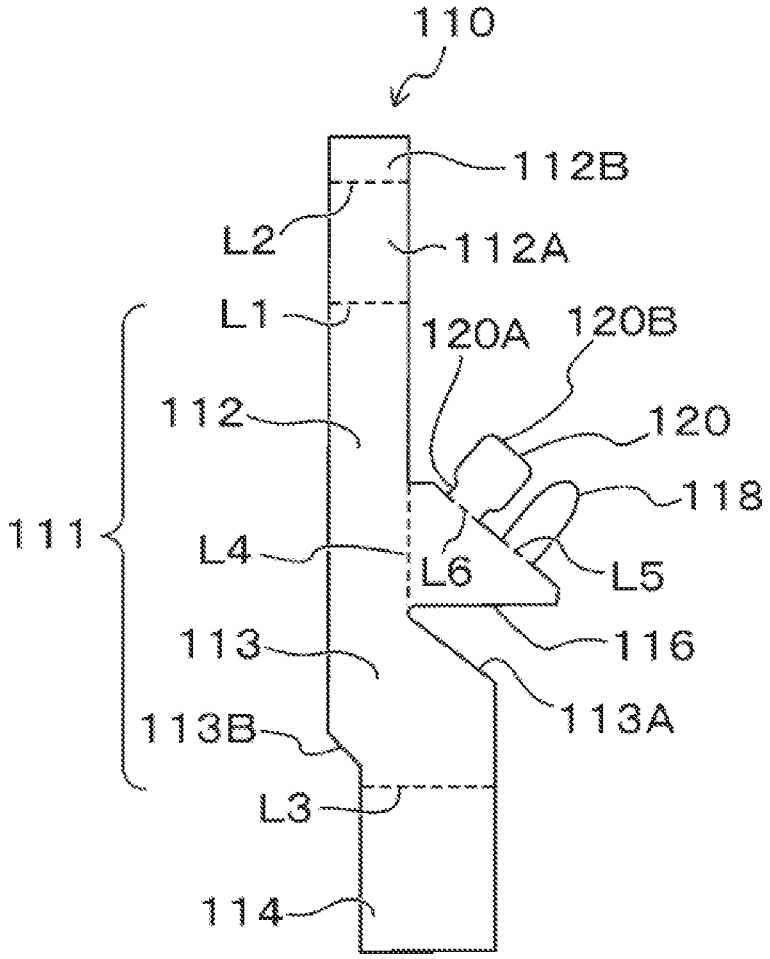
FIGS. 9*a* to 9*c* illustrate a step of bending the terminal metal attachment of FIG. 8.
Figure 9B:
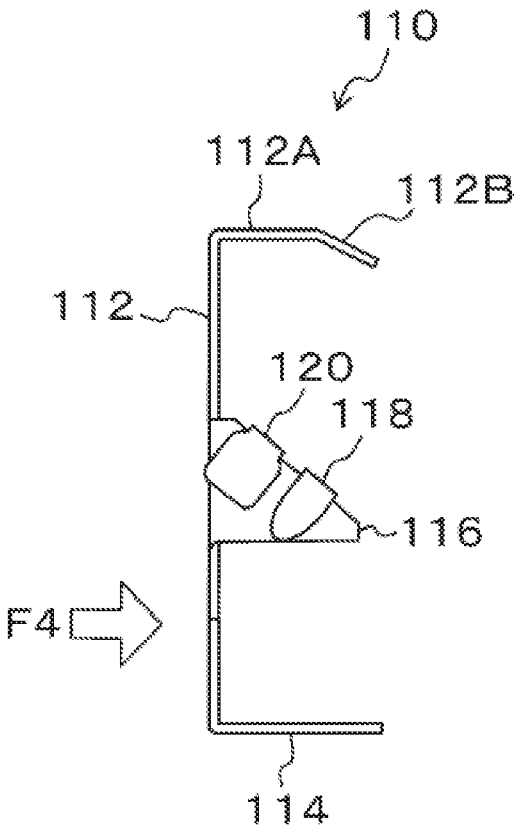
Figure 9C:
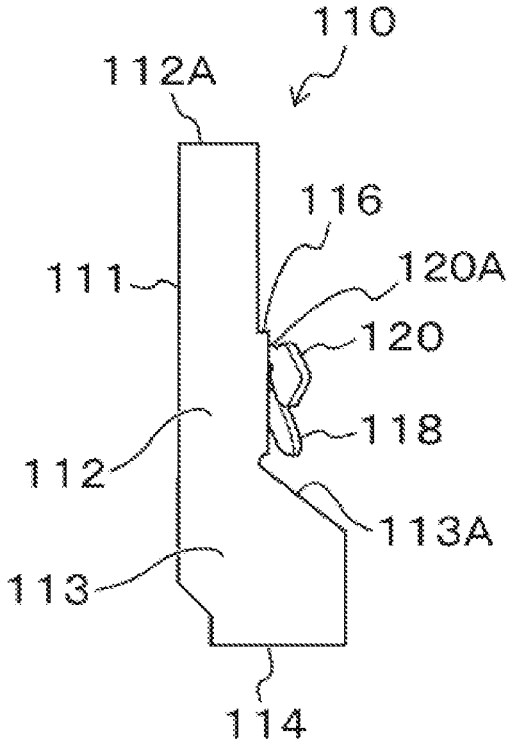

Next, a step of bending the terminal metal attachments will be described with reference to FIGS. 9*a* to 9*c*. FIGS. 9*a* to 9*c* illustrate a step of bending the terminal metal attachment 110. Although the terminal metal attachment 110 will be described as an example illustrated in FIGS. 9*a* to 9*c*, those skilled in the art would understand that the other terminal metal attachments 110', 130, 130' can also be bent in the same manner.

Referring to FIG. 9*a*, the upper portion of the strip portion 112 of the terminal metal attachment 110 is firstly bent along the broken lines L1 and L2, and an upper surface contact portion 112A and a fitting portion 112B are formed as shown in FIG. 9*b*. Further, by bending the expanded portion 113 along the broken line L3, a mounting portion 114 is formed as shown in FIG. 9*b*. Moreover, by bending the strip portion 112 along the broken line L4, the junction surface 116 as illustrated in FIG. 9*b* is obtained. Further, by bending the junction surface 116 along the broken lines L5 and L6, the clamping piece 118 and the fastening portion 120 are formed as illustrated in FIGS. 9*b* and 9*c*.

The terminal metal attachment 110 bent in this manner has the configuration shown in FIG. 9*b*. The terminal metal attachment 110 bent in this way is then attached on the end surface 16C of the flange 16. The terminal metal attachment 110 is attached on the flange 16 such that the side surface portion 111 contacts the flange end surface 16E, the upper surface contact portion 112A contacts the flange upper surface 16B, the fitting portion 112B is fitted with the chamfered portion 16G of the flange 16, the mounting portion 114 contacts the flange lower surface 16A, and the junction surface 116 contacts the bottom surface of the groove 18 in the flange 16. In the same manner, the terminal metal attachment 110' is attached on the end surface 22C of the flange 22.

The terminal metal attachment 130' is also attached on the end surface 22C of the flange 16 in the same manner. More specifically, the terminal metal attachment 130 that has been bent similarly to the terminal metal attachment 110 illustrated in FIG. 9B is attached on the flange 16 such that the side surface portion 131 contacts the flange end surface 16E, the upper surface contact portion 132A contacts the flange upper surface 16B, the fitting portion 132B is fitted with the chamfered portion 16G of the flange 16, the mounting portion 134 contacts the flange lower surface 16A, and the junction surface 136 contacts the bottom surface of the groove 20 in the flange 16. In the same manner, the terminal metal attachment 130' is attached on the end surface 22D of the flange 22.

The plate core 60 is, for example, a plate-like member formed of a Ni—Zn ferrite material and is bonded to the upper surface 16B of the flange 16 and the upper surface 22B of the flange 22 with an epoxy (Tg 125° C. specification). For example, the plate core 60 is configured to have a length of 4.5 mm, a width of 3.2 mm, and a height of 0.6 mm. In one embodiment of the disclosure, the permeability (μ) of the plate core 60 is in the range of 400 to 1000, for example 500.

Figure 6:
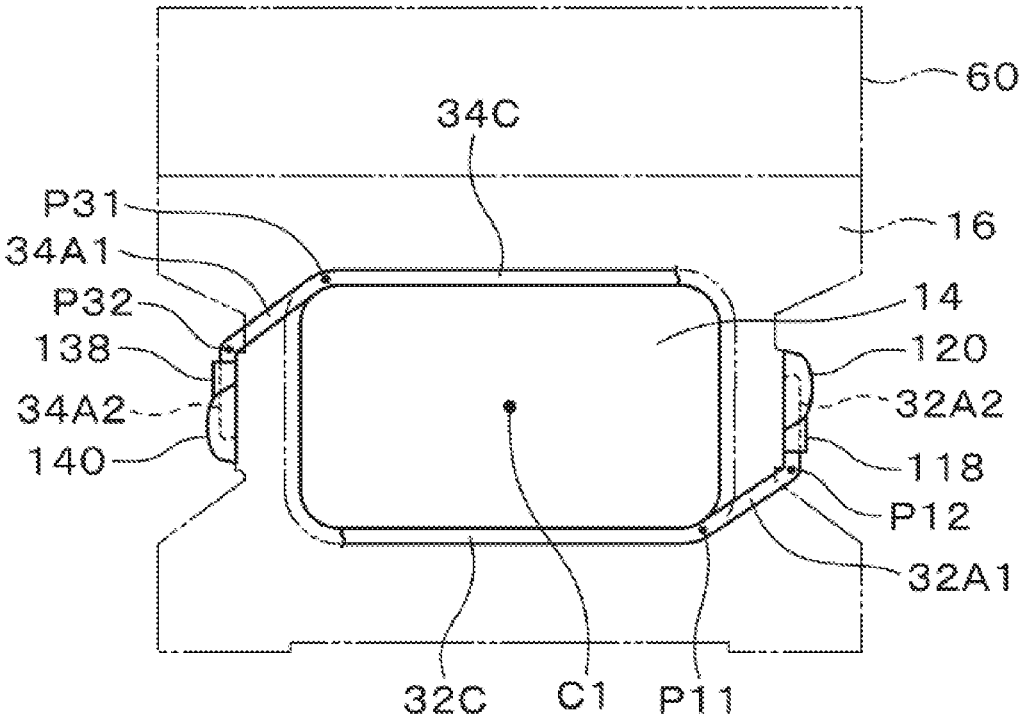
FIG. 6 is a schematic view of the common mode filter of FIG. 1 showing an arrangement of windings as viewed from the left side surface.
Figure 7:
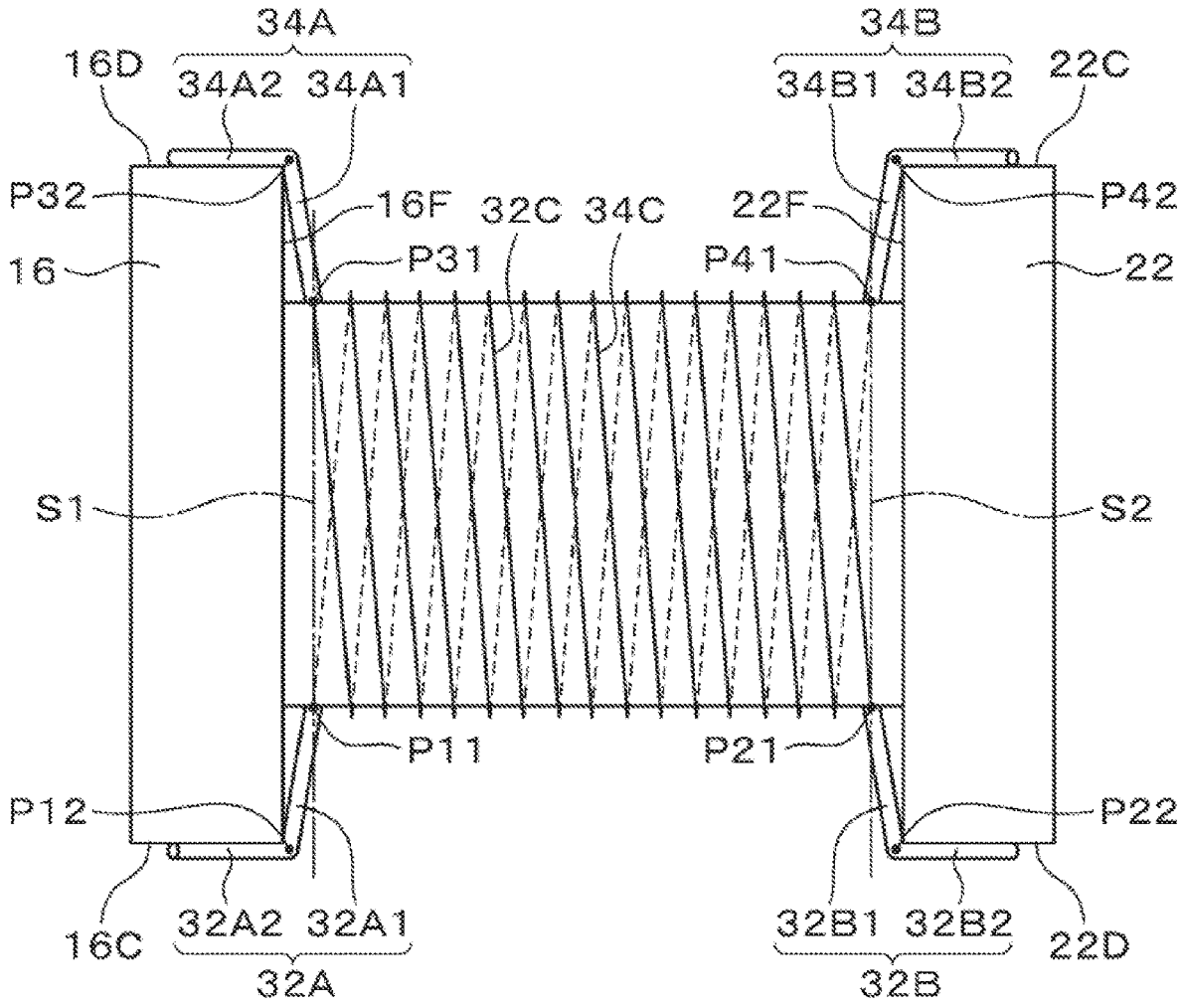
FIG. 7 is a schematic view of the common mode filter of FIG. 1 showing the arrangement of windings as viewed from the upper surface (as viewed from the arrow F1*d*).

An arrangement of the winding wire 32 and the winding wire 34 with respect to the drum core 12 will be now described with reference to FIGS. 6 and 7. FIG. 6 is a schematic view of the common mode filter 100 showing an arrangement of windings 32 and 34 as viewed from the left side surface (as viewed from the arrow Fib). FIG. 7 is a schematic view of the common mode filter 100 showing an arrangement of the windings 32 and 34 as viewed from the upper surface (as viewed from the arrow F1*d*).

Referring to FIGS. 6 and 7, the winding wire 32 includes a winding portion 32C wound around the outer surface of the winding core 14 from a winding start position P11 to a winding end position P21, a lead portion 32A that extends from the winding start position P11 and is connected to the terminal electrode 40; and a lead portion 32B that extends from a winding end position P21 and is connected to the terminal electrode 46. The winding wire 34 includes a winding portion 34C wound around the outer surface of the winding core 14 from a winding start position P31 (see FIG. 5) to a winding end position P41, a lead portion 34A that extends from the winding start position P31 and is connected to the terminal electrode 42; and a lead portion 34B that extends from a winding end position P41 and is connected to the terminal electrode 44. As described above, the winding portion 32C (34C) is a portion that is directly or indirectly wound on the outer peripheral surface of the winding core 14. When the winding has one winding, the winding portion of the winding is directly wound on the outer peripheral surface of the winding core 14. Whereas when the winding is wound in twice or more over the first layer of the winding, the winding portion of the second or more layers of the winding are indirectly wound around the outer peripheral surface of the winding core 14 via the layer(s) of the winding situated thereunder. The lead portion 32A (34A) refers to a portion that extends from one end of the winding wire 32 (34) to the winding portion 32C (34C), and the lead portion 32B (34B) refers to the portion that extends from the other end of the winding wire 32 (34) to the winding portion 32C (34C).

In one embodiment of the disclosure, the lead portion 32A of the winding wire 32 has a bridge portion 32A1 that linearly extends from the winding start position P11 to a flange contact position P12 at the inner end of the end surface 16C of the flange 16, and a junction portion 32A2 that extends from the flange contact position P12 to the fastening portion 120 through the clamping piece 118. The winding wire 32 is electrically connected to the terminal metal attachment 110 (the terminal electrode 40) through the junction portion 32A2. The junction portion 32A2 linearly extends from the flange contact position P12 to the clamping piece 118. The winding wire 32 is secured to the terminal electrode 40 by clamping the lead portion 32A between the junction surface 116 and the clamping piece 118, and melting the fastening portion 120 as necessary to weld the tip of the lead portion 32A onto the junction surface 116. In the specification, a portion of the terminal electrode 40 on which the winding wire 32 is fixed is referred to as a securing portion of the terminal electrode 40. The securing portion of the terminal electrode 40 includes at least one or all of the junction surface 116, the clamping piece 118, and the fastening portion 120.

The lead portion 32B of the winding wire 32 has a bridge portion 32B1 that linearly extends from the winding end position P21 to a flange contact position P22 at the inner end of the end surface 22D of the flange 22, and a junction portion 32B2 that extends from the flange contact position P22 to the fastening portion 140' through the clamping piece 138'. The winding wire 32 is electrically connected to the terminal metal attachment 130' (the terminal electrode 46) through the junction portion 32B2. The junction portion 32B2 linearly extends from the flange contact position P22 to the clamping piece 138'. The winding wire 32 is fixed to the terminal electrode 46 by clamping the lead portion 32B between the junction surface 136' and the clamping piece 138', and melting the fastening portion 140' as necessary to weld the tip of the lead portion 32B onto the junction surface 136'. In the specification, a portion of the terminal electrode 46 on which the winding wire 32 is fixed is referred to as a securing portion of the terminal electrode 46. The securing portion of the terminal electrode 46 includes at least one or all of the junction surface 136', the clamping piece 138', and the fastening portion 140'.

In one embodiment of the disclosure, the lead portion 34A of the winding wire 34 has a bridge portion 34A1 that linearly extends from the winding start position P31 to a flange contact position P32 at the inner end of the end surface 16D of the flange 16, and a junction portion 34A2 that extends from the flange contact position P32 to the fastening portion 140 through the clamping piece 138. The winding wire 34 is electrically connected to the terminal metal attachment 130 (the terminal electrode 42) through the junction portion 34A2. The junction portion 34A2 linearly extends from the flange contact position P32 to the clamping piece 138. The winding wire 34 is fixed to the terminal electrode 42 by clamping the lead portion 34A between the junction surface 136 and the clamping piece 138, and melting the fastening portion 140 as necessary to weld the tip of the lead portion 34A onto the junction surface 136. In the specification, a portion of the terminal electrode 42 on which the winding wire 34 is fixed is referred to as a securing portion of the terminal electrode 42. The securing portion of the terminal electrode 42 includes at least one or all of the junction surface 136, the clamping piece 138, and the fastening portion 140.

In one embodiment of the disclosure, the lead portion 34B of the winding wire 34 has a bridge portion 34B1 that linearly extends from the winding end position P41 to a flange contact position P42 at the inner end of the end surface 22C of the flange 22, and a junction portion 34B2 that extends from the flange contact position P42 to the fastening portion 120' through the clamping piece 118'. The winding wire 34 is electrically connected to the terminal metal attachment 110' (the terminal electrode 44) through the junction portion 34B2. The junction portion 34B2 linearly extends from the flange contact position P42 to the clamping piece 118'. The winding wire 34 is fixed to the terminal electrode 44 by clamping the lead portion 34B between the junction surface 116' and the clamping piece 118', and melting the fastening portion 120' as necessary to weld the tip of the lead portion 34B onto the junction surface 116'. In the specification, a portion of the terminal electrode 44 on which the winding wire 34 is fixed is referred to as a securing portion of the terminal electrode 44. The securing portion of the terminal electrode 44 includes at least one or all of the junction surface 116', the clamping piece 118', and the fastening portion 120'.

As can be seen in FIG. 6, in one embodiment of the disclosure, the winding start position P11 and the winding start position P31 are situated at positions symmetrical to each other with respect to the center C1 of the winding core 14. The center C1 of the winding core 14 refers to, for example, the center of gravity of the cross section of the winding core 14 (a cross section obtained by cutting the winding core 14 in a plane perpendicular to its axis). For example, when the winding core 14 is formed in a rectangular section as shown in FIG. 6, the intersection point of the diagonal lines is the center C1 of the winding core 14. Similarly, the winding end position P21 and the winding end position P41 are situated at positions symmetrical to each other with respect to the center C1 of the winding core 14.

In one embodiment of the disclosure, the flange contact position P12 and the flange contact position P32 may also be situated symmetrical to each other with respect to the center C1 of the winding core 14. In addition, the flange contact position P22 and the flange contact position P42 may also be arranged symmetrical to each other with respect to the center C1 of the winding core 14.

As can be seen in FIG. 7, in one embodiment of the disclosure, both the winding start position P11 and the winding start position P31 are situated in a virtual plane 51 that is parallel to the inner side surface 16F of the flange 16. With this arrangement, the distance from the winding start position P11 to the flange 16 (the length of a perpendicular line drawn from the winding start position P11 to the side surface 16F of the flange 16) and the distance from the winding start position P31 to the flange 16 (the length of the perpendicular line drawn from the winding start position P31 to the side surface 16F of the flange 16) are made equal to each other. Similarly, both the winding end position P21 and the winding end position P41 are situated in a virtual plane S2 that is parallel to the inner side surface 22F of the flange 22. With this arrangement, the distance from the winding end position P21 to the flange 22 (the length of a perpendicular line drawn from the winding end position P21 to the side surface 22F of the flange 22) and the distance from the winding end position P41 to the flange 22 (the length of the perpendicular line drawn from the winding end position P41 to the side surface 22F of the flange 22) are made equal to each other.

In one embodiment of the disclosure, the securing portion of the terminal electrode 40 and the securing portion of the terminal electrode 42 described above are arranged symmetrically to each other with respect to the center C1 of the winding core 14. The securing portion of the terminal electrode 44 and the securing portion of the terminal electrode 46 described above are arranged symmetrically to each other with respect to the center C1. For example, in the embodiment illustrated in FIG. 6, in one embodiment of the disclosure, the clamping piece 118 for clamping the junction portion 32A2 of the winding wire 32 and the clamping piece 138 for clamping the joint portion 34A2 of the winding wire 34 are arranged symmetrically to each other with respect to the center C1 of the winding core 14. Further, the clamping piece 138' for clamping the junction portion 32B2 of the winding wire 32 and the clamping piece 118' for clamping the junction portion 34B2 of the winding wire 34 are arranged symmetrically to each other with respect to the center C1 of the winding core 14.

According to the arrangement of the winding wire 32 and the winding wire 34 described above, the length of the bridge portion 32A1 of the winding wire 32 and the length of the bridge portion 34A1 of the winding wire 34 are made equal to each other so that the length of the bridge portion 32B1 of the winding wire 32 and the length of the bridge portion 34B1 of the winding wire 34 are made equal to each other. The length of the junction portion 32A2 of the winding wire 32 and the length of the junction portion 34A2 of the winding wire 34 are made equal to each other so that the length of the junction portion 32B2 of the winding wire 32 is made equal to the length of the junction portion 34B2 of the winding wire 34.

As described above, according to the embodiment, the length of the lead portion 32A of the winding wire 32 is equal to the length of the lead portion 34A of the winding wire 34, the length of the lead portion 32B of the winding wire 32 is equal to the length of the lead portion 34B of the winding wire 34, the length of the winding portion 32C of the winding wire 32 is equal to the length of the winding portion 34C of the winding wire 34. Therefore, the length of the winding wire 32 and the length of the winding wire 34 are made equal to each other.

Figure 5:
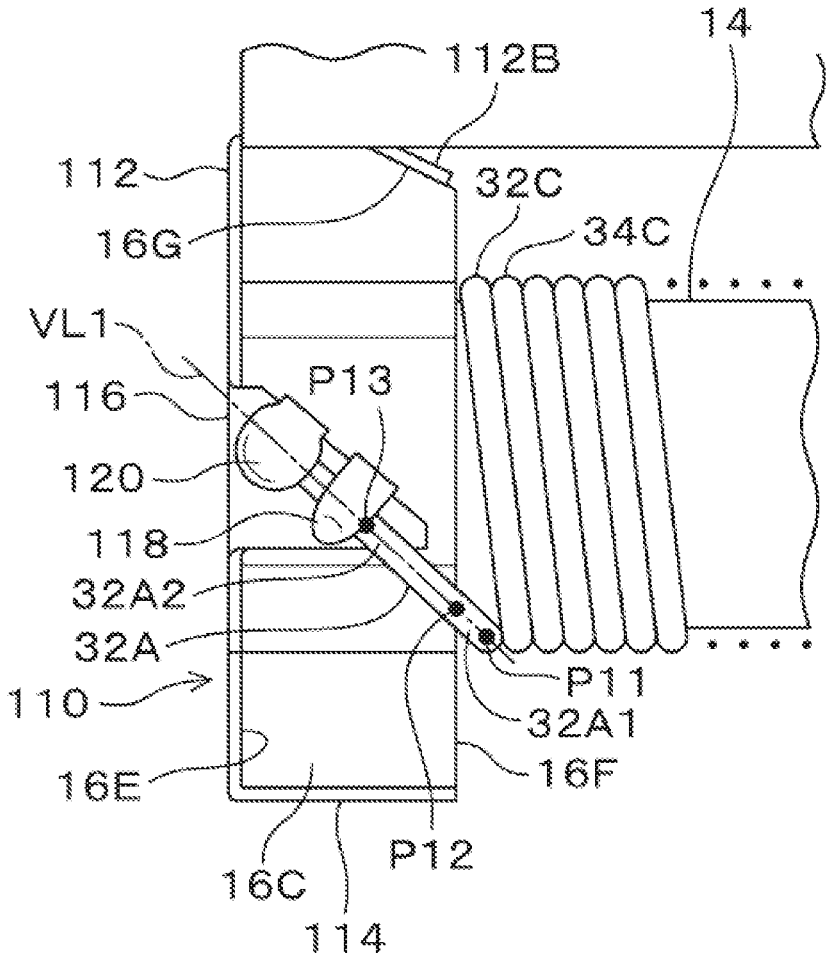
FIG. 5 is an enlarged view of a portion of the common mode filter of FIG. 1 in the vicinity of a flange 16.

In the embodiment of the disclosure, referring to FIG. 5, the lead portion 32A is arranged along an imaginary line VL1 that connects the winding start position P11 and a clamping point P13 situated at a position closest to the winding start position P11 in the clamping piece 118 as viewed from the front. Although not shown, the lead portions 32B, 34A, 34B are arranged in the same manner. For instance, the lead portion 32A is arranged along an imaginary line that connects the winding start position P31 and a clamping point situated at a position closest to the winding start position P31 in the clamping piece 138 as viewed from the front. In such an arrangement, when the lead portions 32A, 32B, 34A, 34B are clamped by the corresponding clamping pieces 118, 138', 138, 118', tension is applied to the lead portions to such an extent that the looseness does not occur.

Next, an example of a manufacturing process of the common mode filter 100 will be described with reference to FIGS. 10*a* to 10*d* First, the drum core 12 is formed. Specifically, a Ni—Zn ferrite material is mixed with a binder, and the mixture material is compression molded using a molding die to obtain a drum-shaped molded body. Deburring may be carried out for this molded body if necessary. By sintering the molded body at a predetermined firing temperature, the drum core 12 that has the shaft portion 14 and the flanges 16, 22 is obtained.

A plate core 60 is also formed. To obtain the plate core 60, a Ni—Zn ferrite material is mixed with a binder, and the mixture material is compression molded using a molding die to obtain a plate-like molded body. By sintering this molded body, the plate core 60 is obtained.

Also, the bent terminal metal attachments 110, 110', 130, 130' shown in FIG. 9*b* are prepared.

Figure 10A:
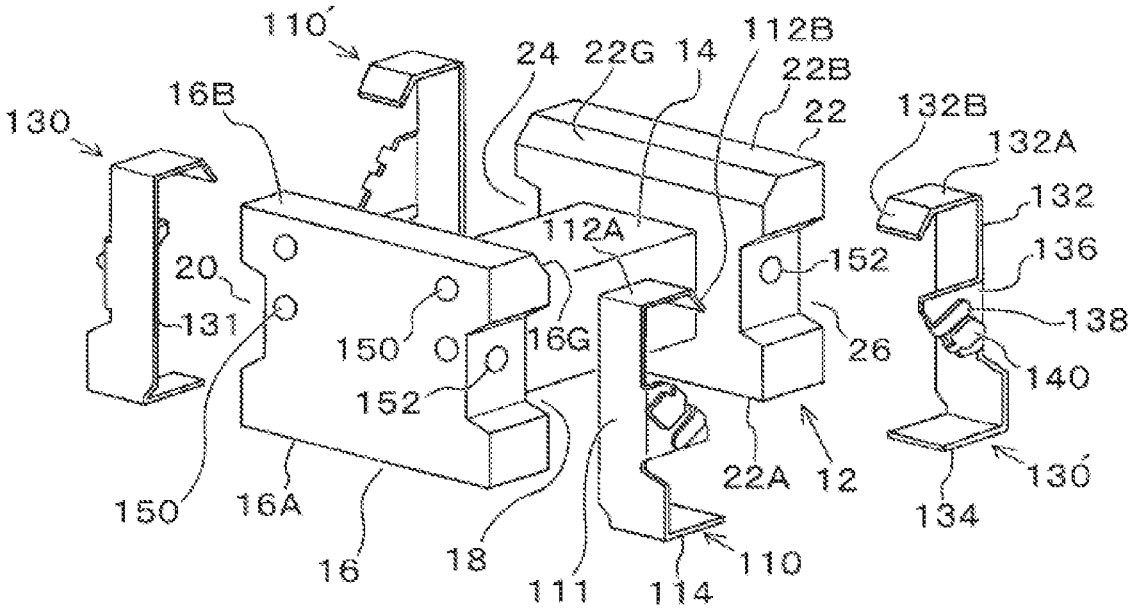
FIGS. 10*a* to 10*d* illustrates an example of a manufacturing process of the common mode filter of FIG. 1.

Subsequently, as illustrated in FIG. 10*a*, the terminal metal attachments 110, 110' are attached to the end surface 16C of the flange 16 and the end surface 22C of the flange 22, respectively. The terminal metal attachments 130, 130' are attached on the end surface 22D of the flange 22 and the end surface 16D of the flange 16. At this point, adhesive may be applied to either or both of an end-surface junction position 150 and a side-surface adhesive position 152 in order to enhance the junction and alignment of the attached terminal metal attachments 110, 110', 130, 130' at predetermined positions in the outer end surfaces 16E, 22E of the flanges 16, 22. The end-surface junction position 150 is situated above the center in the height direction of the flanges 16, 22.

Figure 10B:
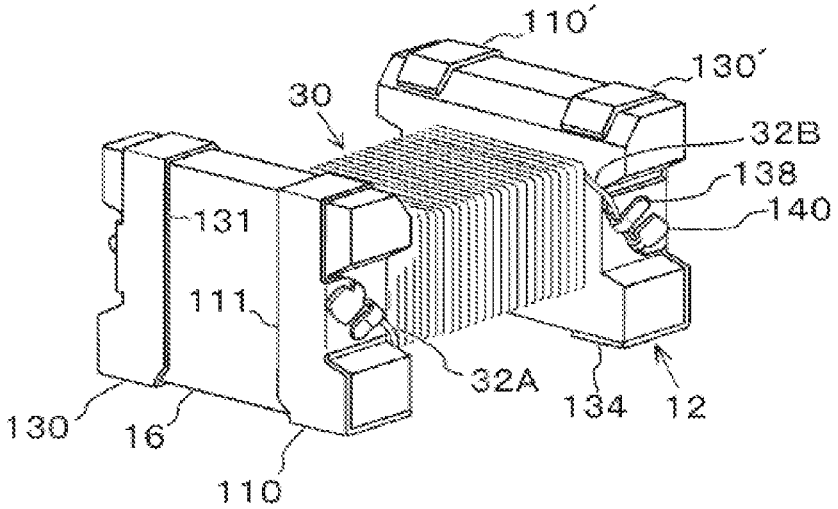

Next, referring to FIG. 10*b*, the winding wire 32 is wound around the outer peripheral surface of the shaft portion 14 as many times as necessary, and then the winding wire 34 is wound around the outer peripheral surface of the shaft portion 14. The winding wire 34 is wound adjacently to the winding wire 32 and wound the same number of times in the same circumferential direction as the winding wire 32.

Figure 10C:
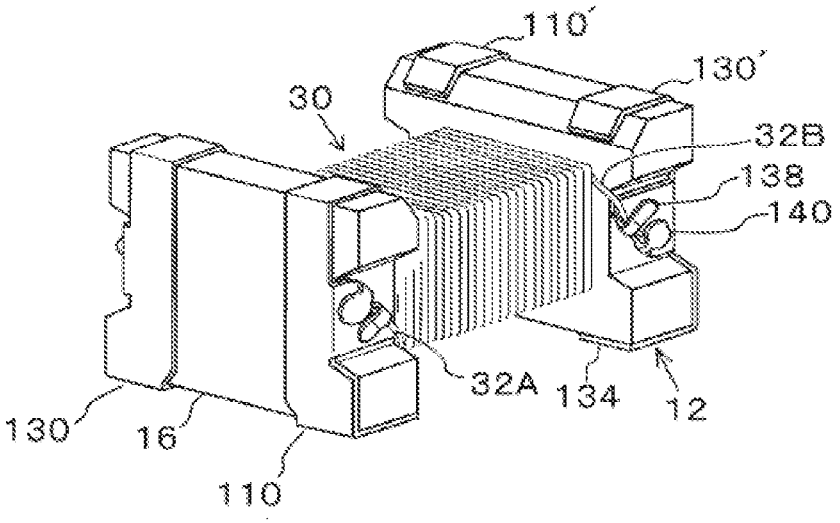

Next, referring to FIG. 10*c*, the temporarily fastened lead portions 32A, 32B, 34A, 34B are fixed by welding. More specifically, the fastening portions 120, 140 are melted by using a YAG laser to weld the lead portions 32A, 32B, 34A, 34B so as to fix them.

Figure 10D:
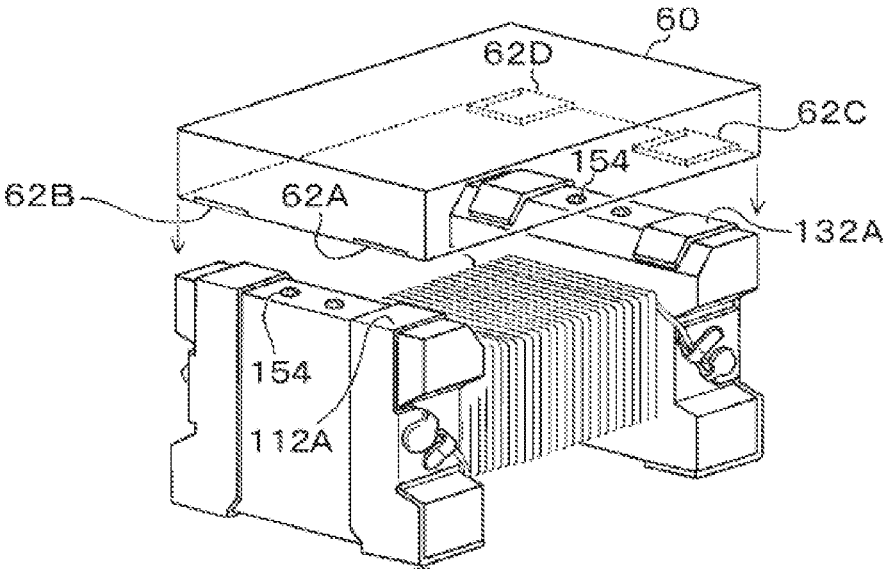

Subsequently, referring to FIG. 10*d*, an adhesive is applied to the upper surface junction positions 154 of the upper surface 16B of the flange 16 and the upper surface 22B of the flange 22, and the plate core 60 is then bonded to the upper surface 16B and the upper surface 22B. When the plate core 60 is adhered, the plate core 60 is aligned with the flange 16 and the flange 22 such that the recesses 62A, 62B, 62C, 62D face the upper contact portions 112A, 132A of the terminal metal attachments 110, 130. The common mode filter 100 obtained as described above is mounted on an electronic component or the like by soldering the mounting portions 114, 134 of the terminal metal attachments 110, 110', 130, 130'.

More specifically, the winding wire 32 is temporarily fastened to the junction surface 116 by clamping the lead portion 32A with the junction surface 116 and the clamping piece 118. Subsequently, the fastening portion 120 is melted by using a YAG laser, so that the tip of the lead portion 32A where is exposed from the clamping piece 118 is welded to the junction surface 116. Thus, one end of the winding wire 32 is secured to the terminal metal attachment 110. Next, the winding wire 32 is extended from the clamping piece 118 to the winding start position P11 via the flange contact position P12. And the winding wire 32 is wound on the outer surface of the winding core 14 from the winding start position P11 to the winding end position P21. Subsequently, the lead portion 32B of the winding wire 32 is extended from the winding end position P21 via the flange contact position P22 to the clamping piece 138', and the lead portion 32B is clamped between the junction surface 136' and the clamping piece 138' to temporarily fasten the winding wire 32 to the junction surface 136'. The fastening portion 140 is then melted by using a YAG laser, so that the tip of the lead portion 32B where is exposed from the clamping piece 138' is welded to the junction surface 136'. The winding wire 34 is wound around the winding core 14 in the same manner. By this junction procedure, since the winding wire 32 is temporarily fastened by the clamping piece 138' at the time of welding so that it is possible to prevent the winding wire 32 from being loosened during the welding.

Figure 12A:
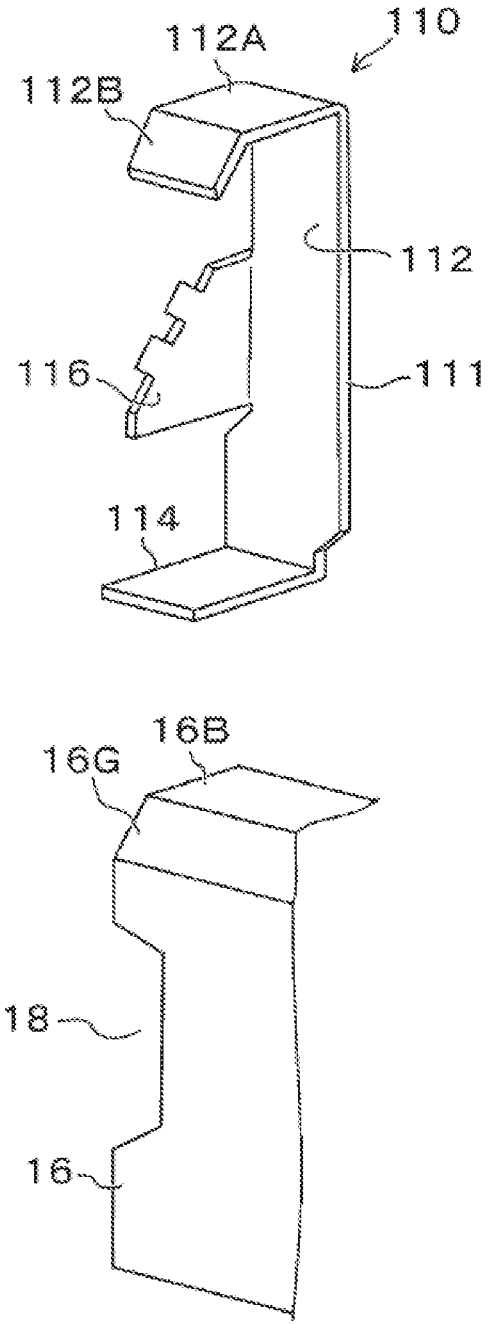
FIGS. 12*a* to 12*c* illustrate a terminal metal attachment provided in a common mode filter according to another embodiment of the disclosure.
Figure 12B:
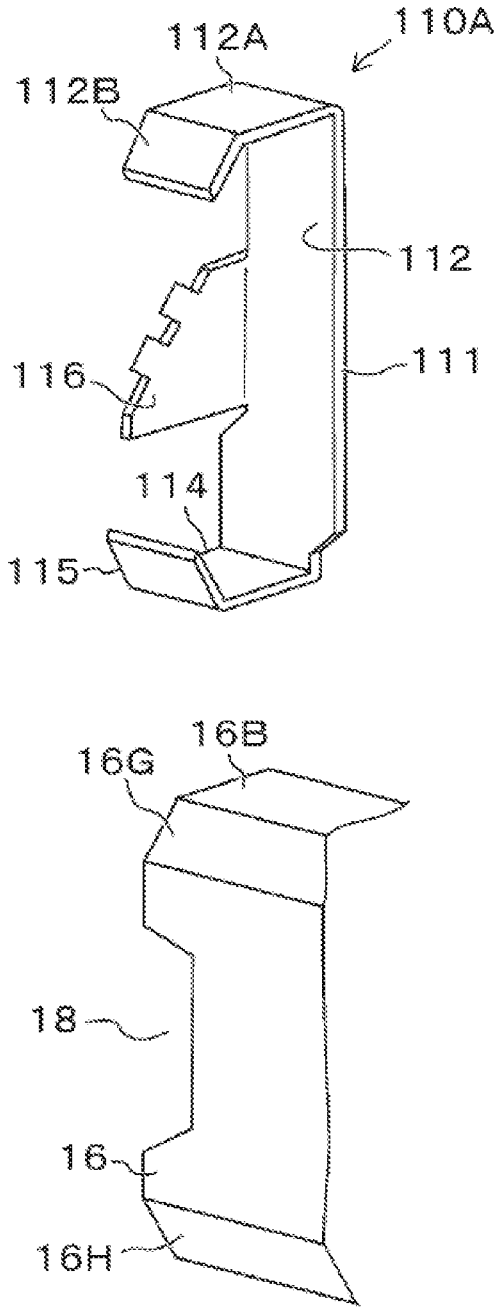
Figure 12C:
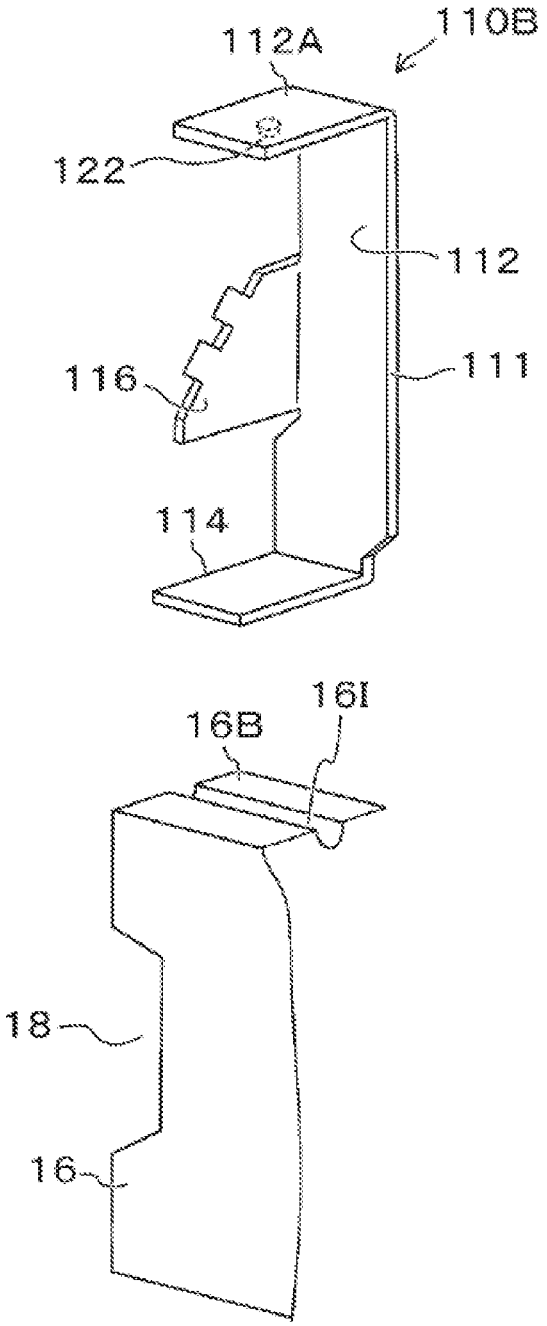

A terminal metal attachment provided in a common mode filter according to another embodiment of the disclosure will be now described with reference to FIG. 12. FIG. 12*a* illustrates the above-described terminal metal attachment 110 again for comparison. The terminal metal attachment 110 has a fitting portion 112B that is formed by bending a tip of the upper surface contact portion 112A and engages with a chamfered portion 16G provided on the flange upper surface 16B side. In the terminal metal attachment 110A shown in FIG. 12B, a fitting portion 115 is formed by bending the lower side of the end surface portion 112, that is, the tip of the mounting portion 114. The fitting portion 115 is engaged with the chamfered portion 16H provided on the flange lower surface 16A. Accordingly, in the terminal metal attachment 110A, the fitting portions 112B, 115 can be engaged with the chamfered portions 16G, 16H provided in the upper and lower portions of the flange. In the terminal metal attachment 110B shown in FIG. 12C, a protrusion 122 is provided on the inner side of the upper surface contact portion 112A, and an upper surface groove 161 to which the protrusion 122 is engaged is provided on the flange upper surface 16B.

The terminal metal attachments applicable to the disclosure are not limited to those shown in the drawings. For example, in addition to the flange upper surface, the protrusion may also be formed in the mounting portion 114 and the groove may be formed in the flange lower surface 16A. Further, a chamfered portion 16H may be provided on the flange lower surface 16A, an upper surface groove 161 for alignment may be provided in the flange upper surface 16B, the protrusion 122 may be provided on the upper surface contact portion 112A of the terminal metal attachment, and the fitting portion 115 may be formed by bending the tip of the mounting portion 114.

Figure 11A:
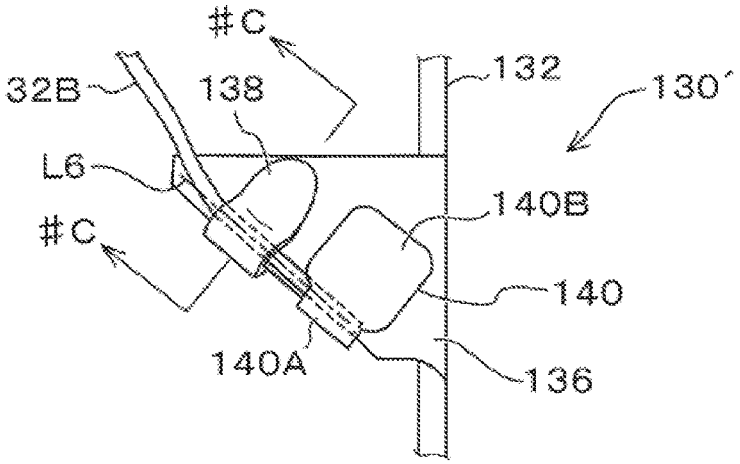
FIGS. 11*a* to 11*c* are enlarged views of a part of the terminal metal attachment of FIG. 8.
Figure 11B:
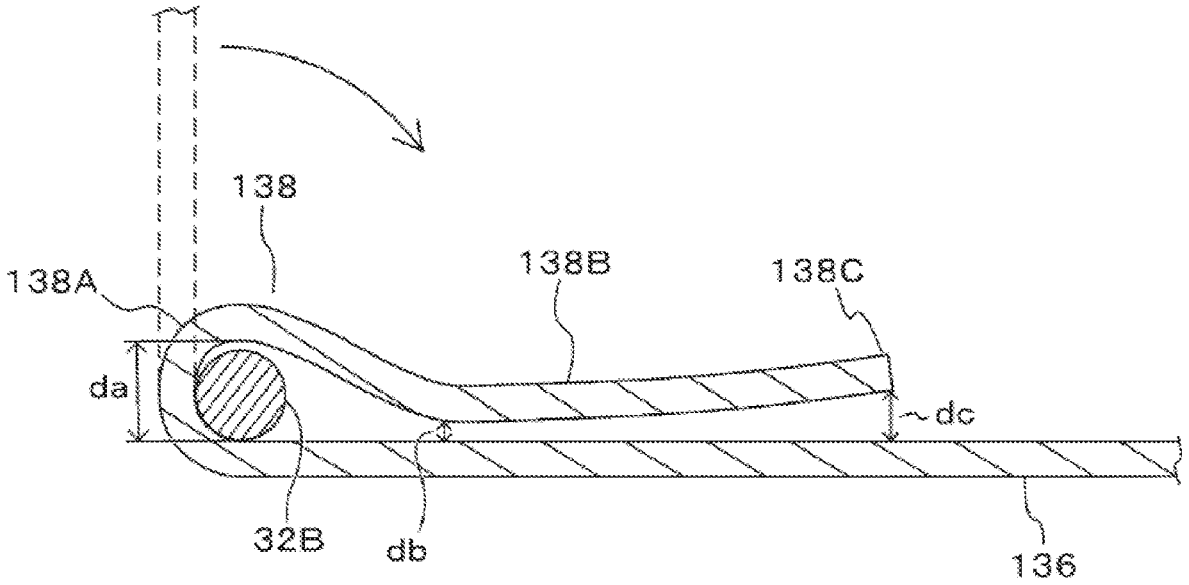
Figure 11C:
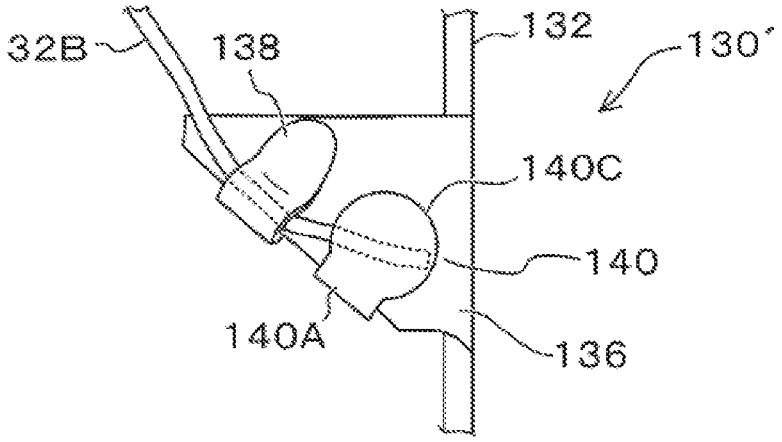

A junction mechanism in which the winding wire 32 is connected to the junction surface 136 of the terminal metal attachment 130' will be described with reference to FIGS. 11*a* to 11*c*. FIGS. 11*a* and 11*c* are enlarged views of the terminal metal attachment 130', and FIG. 11*b* is a sectional view of FIG. 11*a* along the line # C-# C. Referring to FIG. 11*b*, the clamping piece 138 is formed by folding a flat plate member that stands from one side of the junction surface 136 toward the junction surface 136 along the folding line L6.

The clamping piece 138 includes a receiving portion 138A, a constricting portion 138B, and a tip portion 138C stated in the order closer to the folding line L6. The receiving portion 138A, the constricting portion 138B, and the tip portion 138C are separated from the junction surface by the distance "da", the distance "db", and the distance "dc", respectively. The clamping piece 138 is formed such that the distance "da" is larger than both of the distance "db" and the distance "dc". It is preferable that the clamping piece 138 be formed such that the distance "da" is larger than the diameter of the winding wire 32. Thereby, it is possible to clamp the winding wire 32 without damaging the winding wire 32.

In one embodiment of the disclosure, the clamping piece 138 is formed such that the distance "db" is smaller than the distance da and the distance "dc", and smaller than the diameter of the winding wire 32. In this way, it is possible to prevent the winding wire 32 that has been inserted through the receiving portion 138A from being displaced from the receiving portion 138A. The distance dc between the tip portion 138C and the junction surface 136 is set to be smaller than the distance da and larger than the distance db.

In one embodiment of the disclosure, the clamping piece 138 is configured such that the folding line L6 is arranged collinearly with a virtual line VL1 (see FIG. 5) that connects the winding start position P11 and the clamping point P13. Thus, the lead portion 32B can be clamped over the entire width of the receiving portion 138A of the clamping piece 138, so that it is possible to hold the lead portion 32B stably.

The tip end of the winding wire 32 exposed from the clamping piece 138 is disposed at a position overlapping with the wide portion 140B of the fastening portion 140 while the lead portion 32B is temporarily fixed to the clamping piece 138. Similarly to the clamping portion 138, the fastening portion 140 is also formed by folding a flat plate member that stands upright from one side of the junction surface 136 toward the junction surface 136. The tip of the winding wire 32 is disposed so as to overlap with the fastening portion 140 and the fastening portion 140 is then melted using a YAG laser. The melted portion swells and its width shrinks, and a connecting portion 140C that has a rounded shape is formed.

The terminal metal attachments 110, 110', 130 are also configured similarly to the terminal metal attachments 130' described above.

Figure 13:
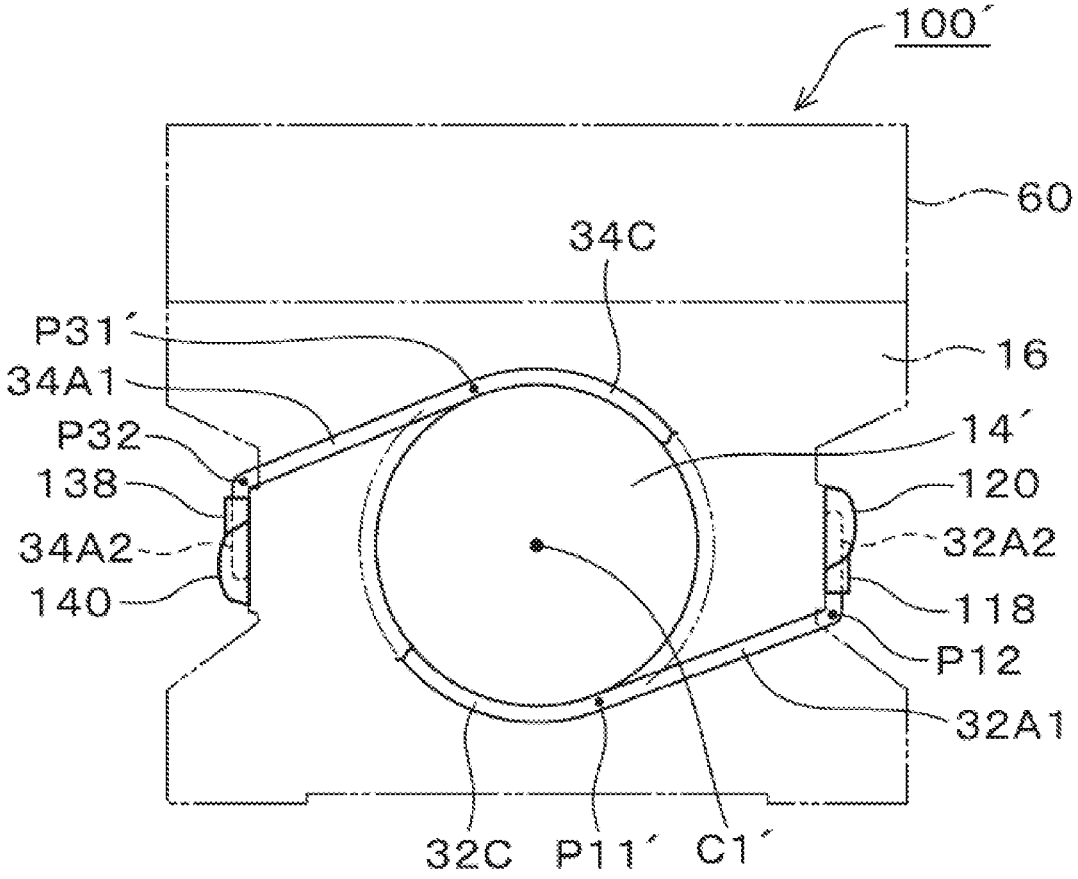
FIG. 13 is a schematic view of the common mode filter according to the other embodiment showing an arrangement of windings as viewed from the left side surface.

Arrangement of the windings provided in a common mode filter according to another embodiment of the disclosure will be now described with reference to FIG. 13. FIG. 13 is a schematic view of the common mode filter according to the other embodiment showing the arrangement of windings as viewed from the left side surface. The common mode filter in the embodiment shown in FIG. 13 has a winding core 14' having a circular cross section. The center of the winding core 14' is represented by C1'. The common mode filter 100' shown in FIG. 13 has the winding core 14' that has a different shape from the common mode filter 100 in FIG. 6. Since the shape of the winding core is different, it is natural that the positions of the winding start position P11' and the winding start position P31' shown in FIG. 13 are different from the winding start position P11 and the winding start position P31 shown in FIG. 6.

Also in the common mode filter 100' shown in FIG. 13, the winding start position P11' and the winding start position P31' are arranged symmetrically to each other with respect to the center C1' of the winding core 14. The clamping piece 118 and the clamping piece 138 are arranged symmetrically to each other with respect to the center C1' of the winding core 14. Although not shown in the drawing, in the common mode filter 100' of FIG. 13, the winding ending position and the winding ending position are arranged symmetrically to each other with respect to the center C1' of the winding core 14'.

Even if the cross-sectional shape of the winding core is different, by arranging the corresponding winding start positions, the corresponding winding end positions and the securing portions symmetrically with respect to the center of the winding core, it is possible to equalize the length of the lead portion 32A of the winding wire 32 and the length of the lead portion 34A of the winding wire 34 and it is possible to equalize the length of the lead portion 32B of the winding wire 32 and the length of the lead portion 34B of the winding wire 34. Also in the common mode filter 100' shown in FIG. 13, since the winding portion 32C and the winding portion 34C are wound by the same number of turns in the same circumferential direction as are in the common mode filter 100. Therefore, in the common mode filter 100', by arranging the corresponding winding start positions, the corresponding winding end positions, and the clamping pieces symmetrically with respect to the center of the winding core, it is possible to equalize the length of the winding wire 32 and the length of the winding wire 34.

Figure 14:
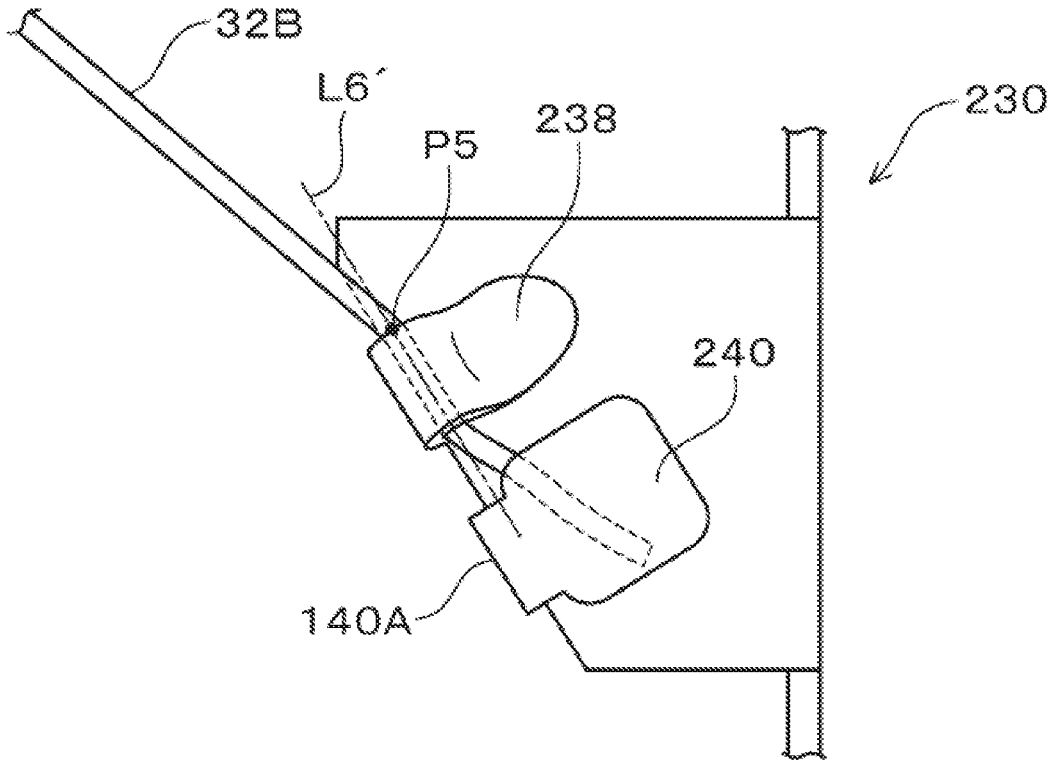
FIG. 14 is a schematic view of the common mode filter according to another embodiment for describing a securing mechanism for the windings.

Another example of the junction mechanism in which the winding wire 32 is connected to the junction surface of the terminal metal attachment will be described with reference to FIG. 14. FIG. 14 is an enlarged view of a terminal metal attachment 230 according to an embodiment of the disclosure. This terminal metal attachment 230 is applied to the common mode filter 100 in place of the terminal metal attachment 130' shown in FIG. 11.

The terminal metal attachment 230 includes a junction surface 236, a clamping piece 238, and a fastening portion 240. The clamping piece 238 is formed by folding a flat plate member that stands from one side of the junction surface 236 toward the junction surface 236 along the folding line L6'. This folding line L6' is inclined at a larger angle with the axial direction of the winding core 14 compared to the folding line L6 in FIG. 11A. The junction surface 236 shown in FIG. 14 is inclined at a larger angle with the axial direction of the winding core 14 compared to the junction surface 136 in FIG. 11A.

According to such a configuration, when the lead portion 32B enters into the terminal metal attachment 230 at the same angle as FIG. 11A, the bent line L6' is inclined with respect to the lead portion 32B. When the lead portion 32B is attached to the terminal metal attachment 230, the lead portion 32B is firstly arranged to extend along the bending line L6', and then the clamping piece 238 is folded along the folding line L6'. In this way, the lead portion 32B is temporarily fasten to the junction surface 236 as illustrated in FIG. 14. At this point, the lead portion 32B is bent at a bent portion P5. The bent portion P5 is located at a position corresponding to the clamping point closest to the winding end position of the winding wire 32 in the clamping piece 238.

According to such an arrangement, even when a force is applied to the winding wire 32 in a direction in which the winding wire 32 comes off from the clamping piece 238, the bent portion of the lead portion 32B is caught by the clamping piece 238, which prevents the winding wire 32 from coming off.

The dimensions, materials, and arrangements of the various constituent components described in this specification are not limited to those explicitly described in the embodiments, and the various constituent components can be modified to have arbitrary dimensions, materials, and arrangements within the scope of the present invention. The elements other than those explicitly described herein can be added to the described embodiments; and part of the elements described for the embodiments can be omitted. For example, the terminal electrodes 40, 42, 44, 46 may be formed by baking Ag paste on the corresponding flanges 16, 22 and sequentially performing Ni plating and Sn plating on the surface of the baked Ag paste.

What is claimed is:

1. A common mode filter, comprising:

a drum core including a winding core, a first flange provided on one end of the winding core, and a second flange provided on the other end of the winding core, the first flange having a first lower surface that faces a mounting surface of a circuit board and a pair of first end surfaces that intersect the first lower surface, and the second flange having a second lower surface that faces the mounting surface of the circuit board and a pair of second end surfaces that intersect the second lower surface;

a first terminal electrode provided on the first flange and having a first securing portion;

a second terminal electrode provided on the second flange and having a second securing portion;

a third terminal electrode provided on the first flange and having a third securing portion;

a fourth terminal electrode provided on the second flange and having a fourth securing portion;

a first winding wire including a first winding portion, a first lead portion, and a second lead portion, the first winding portion being wound around the winding core from a first winding start position to a first winding end position on the winding core, the first lead portion extending from the first winding start position and being secured by the first securing portion to be connected to the first terminal electrode, and the second lead portion extending from the first winding end position and being secured by the second securing portion to be connected to the second terminal electrode; and a second winding wire including a second winding portion, a third lead portion, and a fourth lead portion, the second winding portion being wound around the winding core from a second winding start position to a second winding end position on the winding core by the same number of turns and in the same direction as the first winding wire, the third lead portion extending from the second winding start position and being secured by the third securing portion to be connected to the third terminal electrode, and the fourth lead portion extending from the second winding end position and being secured by the fourth securing portion to be connected to the fourth terminal electrode; wherein the first winding start position and the second winding start position are arranged at an equal distance from the first flange and arranged symmetrically to each other with respect to a center of the winding core when viewed from a direction along the winding core, the first winding end position and the second winding end position are arranged at an equal distance from the second flange and arranged symmetrically to each other with respect to the center of the winding core when viewed from the direction along the winding core, the first securing portion and the third securing portion are arranged symmetrically to each other with respect to the center of the winding core when viewed from the direction along the winding core, the second securing portion and the fourth securing portion are arranged symmetrically to each other with respect to the center of the winding core when viewed from the direction along the winding core, the first lead portion extends linearly from the first winding start position to a first flange contact position at an inner end of the first end surface on which the first securing portion is disposed, the second lead portion extends linearly from the first winding end position to a second flange contact position at an inner end of the second end surface on which the second securing portion is disposed, the third lead portion extends linearly from the second winding start position to a third flange contact position at an inner end of the first end surface on which the third securing portion is disposed, and the fourth lead portion extends linearly from the second winding end position to a fourth flange contact position at an inner end of the second end surface on which the fourth securing portion is disposed.

2. The common mode filter according to claim 1, wherein the first terminal electrode includes a first junction surface disposed on one of the pair of the first end surfaces, and a first clamping piece formed on the first junction surface, the second terminal electrode includes a second junction surface disposed on one of the pair of the second end surfaces, and a second clamping piece formed on the second junction surface, the third terminal electrode includes a third junction surface disposed on the other of the pair of the first end surfaces, and a third clamping piece formed on the third junction surface, the fourth terminal electrode includes a fourth junction surface disposed on the other of the pair of the second end surfaces, and a fourth clamping piece formed on the fourth junction surface, the first lead portion is clamped between the first junction surface and the first clamping piece to be connected to the first terminal electrode, the second lead portion is clamped between the second junction surface and the second clamping piece to be connected to the second terminal electrode, the third lead portion is clamped between the third junction surface and the third clamping piece to be connected to the third terminal electrode, the fourth lead portion is clamped between the fourth junction surface and the fourth clamping piece to be connected to the fourth terminal electrode.

3. The common mode filter according to claim 2, wherein the first lead portion includes a first bridge portion that extends linearly from the first winding start position to the inner end of the first end surface, and a first junction portion that extends linearly from an end of the first bridge portion to the first clamping piece, the second lead portion includes a second bridge portion that extends linearly from the first winding end position to the inner end of the second end surface, and a second junction portion that extends linearly from an end of the second bridge portion to the second clamping piece, the third lead portion includes a third bridge portion that extends linearly from the second winding start position to the inner end of the third end surface, and a third junction portion that extends linearly from an end of the third bridge portion to the third clamping piece, and the fourth lead portion includes a fourth bridge portion that extends linearly from the second winding end position to the inner end of the fourth end surface, and a fourth junction portion that extends linearly from an end of the fourth bridge portion to the fourth clamping piece.

4. The common mode filter according to claim 2, wherein the first lead portion is arranged along a first line that connects the first winding start position and a first clamping point situated at a position closest to the first winding start position in the first clamping piece as viewed from the front, the second lead portion is arranged along a second line that connects the first winding end position and a second clamping point situated at a position closest to the first winding end position in the second clamping piece as viewed from the front, the third lead portion is arranged along a third line that connects the second winding start position and a third clamping point situated at a position closest to the second winding start position in the second clamping piece as viewed from the front, and the fourth lead portion is arranged along a fourth line that connects the second winding end position and a fourth clamping point situated at a position closest to the second winding end position in the second clamping piece as viewed from the front.

5. The common mode filter according to claim 2, wherein the first clamping piece is folded toward the first junction surface along a first folding line, the first folding line is inclined with respect to the first line as viewed from the front, and the first junction portion is bent at the first clamping point toward the first folding line.

6. The common mode filter according to claim 4, wherein the first clamping piece is folded toward the first junction surface along a first folding line that is arranged collinearly with the first line as viewed from the front.

* * * * *